United States Patent [19]

Stadnyk

[11] Patent Number: 5,074,819

[45] Date of Patent: Dec. 24, 1991

[54] TOY BANK NOVELTY DEVICE

[76] Inventor: Wayne Stadnyk, 706 Brightstand Crescent, Saskatoon, SK S7J4Y6, Canada

[21] Appl. No.: 603,543

[22] Filed: Oct. 26, 1990

[51] Int. Cl.[5] ..... A63H 33/00; A45C 1/12

[52] U.S. Cl. ..... 446/4; 446/9; 446/478; 272/27 N

[58] Field of Search ..... 446/4, 5, 9, 8, 10, 446/11, 12, 13, 76, 478; 272/27 N, 27 R

[56] References Cited

U.S. PATENT DOCUMENTS

| | | | |
|---|---|---|---|
| 677,895 | 7/1901 | Skinner | 446/8 |
| 1,225,393 | 5/1917 | Audsley | 446/4 X |
| 2,398,011 | 4/1946 | Kaplan | 446/8 X |
| 2,955,381 | 10/1960 | Joslyn | 446/1 X |
| 2,990,643 | 7/1961 | Zoeller | 446/9 |
| 4,662,633 | 5/1987 | Zaruba et al. | 446/5 X |
| 4,867,723 | 9/1989 | Asbach | 446/4 |

*Primary Examiner*—Danton D. DeMille
*Attorney, Agent, or Firm*—H. Jay Spiegel

[57] ABSTRACT

The present invention relates to a toy bank novelty device. The toy bank structure is collapsible in nature and includes a mouse trap therewith to cause the structure to fly apart or explode when activated. The mouse trap may be activated by insertion of a coin into the toy bank.

6 Claims, 2 Drawing Sheets

TOY BANK NOVELTY DEVICE

BACKGROUND OF THE INVENTION

The present invention relates to a toy bank novelty device. The present invention includes a toy bank made in the likeness of an outdoor bathroom. The toy bank is made from a collapsible structure which includes therein a mouse trap. The mouse trap is activated by insertion of a coin in a slot in the top of the bank, activation of the mouse trap causing the collapsible structure to fly apart.

In the prior art, toy banks which include means to function in response to the deposit of a coin in the coin slot of the toy bank are known. U.S. Pat. No. 2,521,131 to Sloane and U.S. Pat. No. 2,990,643 Zoeller both disclose a combination toy bank and means to eject a figurine upwardly in response to the deposit of a coin in the bank.

However, applicant is unaware of any prior art that teaches or fairly suggests a toy bank novelty device which includes means to cause the toy bank to fly apart upon the depositing of a coin therein.

SUMMARY OF THE INVENTION

The present invention relates to a toy bank novelty device. The present invention includes the following interrelated aspects and features:

A) In a first aspect, the toy bank novelty device includes a collapsible structure made in the likeness to an outdoor bathroom facility or "outhouse".

B) The collapsible structure includes a top having a coin slot therein, two end portions, two side portions and a base. The base includes a recess therein which is adapted to receive a mouse trap.

C) The sides, ends and top of the collapsible structure engage each other in a manner such that the structure may be readily collapsible.

D) In an exemplary use, a coin may be deposited through the slot in the top and activate the mouse trap located in the base. The action of the mouse trap may then cause the sides, ends and top of the collapsible structure to fly apart, thereby simulating an outdoor bathroom facility exploding.

Accordingly, it is a first object of the present invention to provide an improved toy bank novelty device.

It is a Yet further object of the present invention to provide a toy bank which is made in the likeness of an outdoor bathroom facility.

It is a still yet further object of the present invention to provide a toy bank which includes means to cause the toy bank to fly apart upon depositing of a coin therein.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
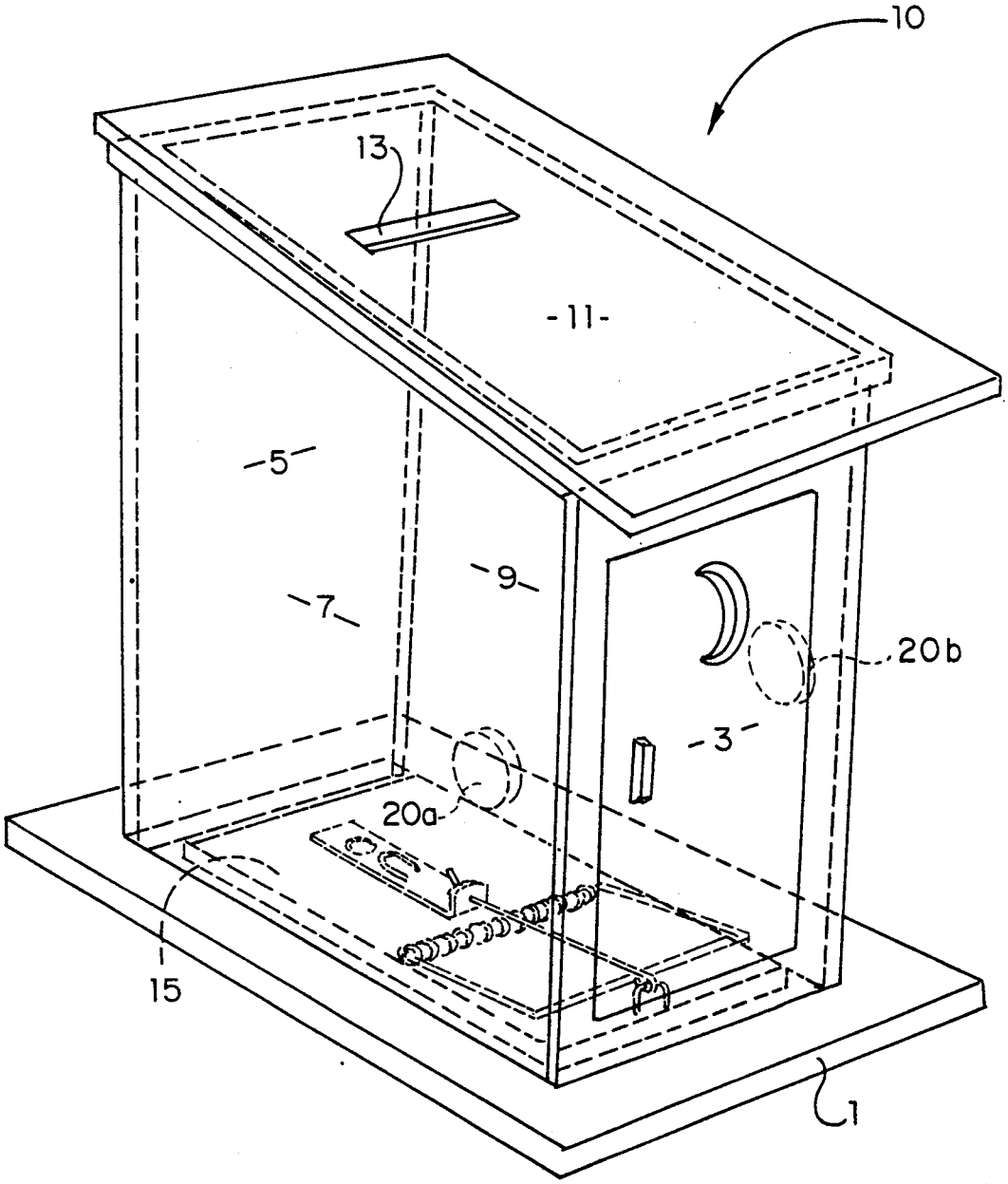
FIG. 1 shows a perspective view of the inventive toy bank novelty device.

With reference to FIG. 1 firstly, the toy bank novelty device is generally designated by the reference numeral 10 and is seen to include a plurality of pieces including a base 1, end portions 3 and 5, side portions 7 and 9, and a top 11. The base 1 is designed to receive a mouse trap 15, having the usual trip lever and spring biased pivotable bar, the mouse trap providing the necessary action to cause the collapsible structure to fly apart upon activation.

Figure 2:
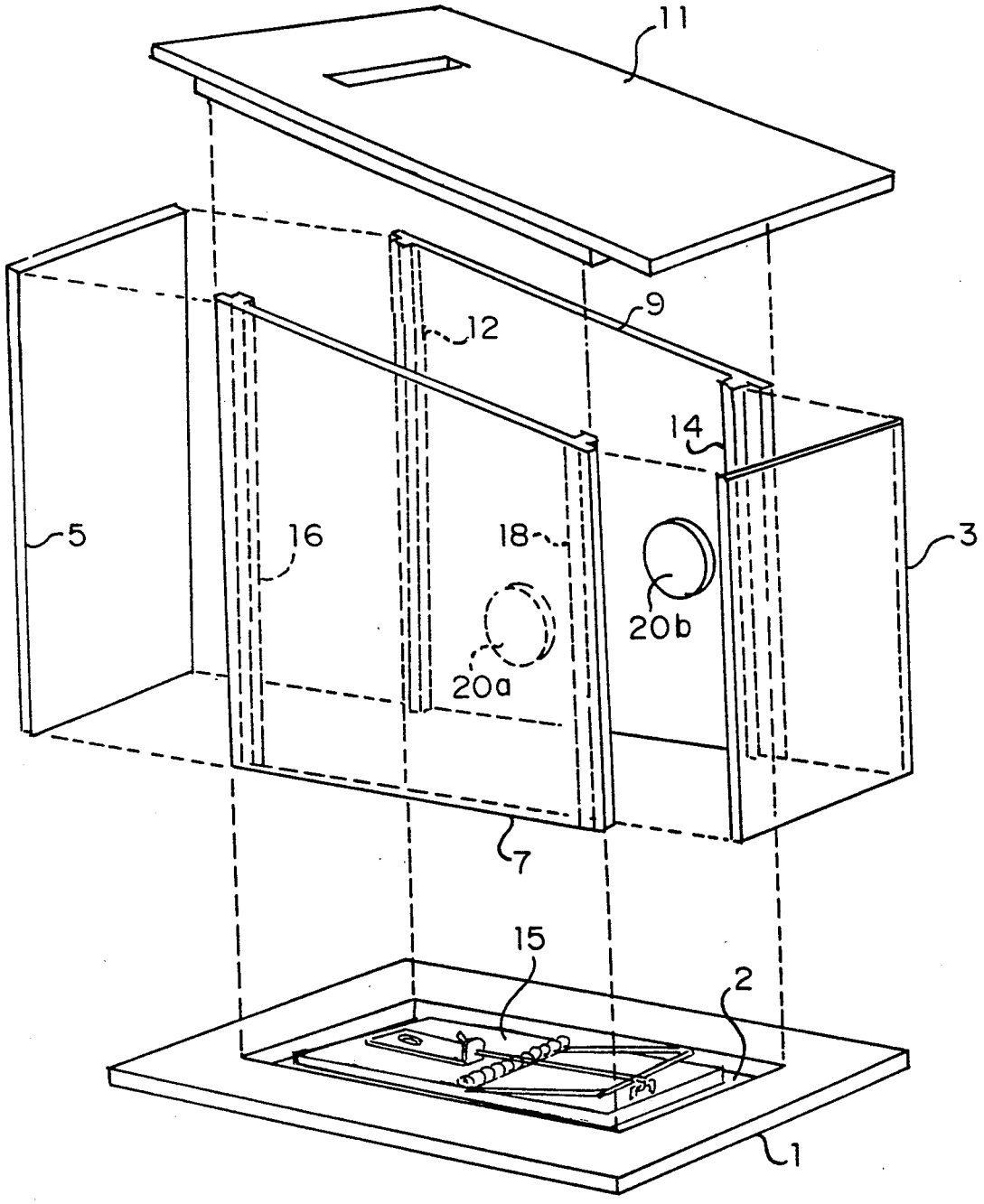
FIG. 2 shows an exploded view of the toy bank novelty device.

With reference to FIG. 2, an exploded view of the inventive device is shown to more clearly illustrate the collapsible nature of the toy bank novelty device. As can be seen from FIG. 2, side portion 7 includes a pair of stops 16 and 18 and stop 20*a* thereon with side portion 9 including a pair of stops 12 and 14 and stop 20*b* thereon. The stops 14 and 18 are designed to engage end portion 3 with stops 12 and 16 designed to engage end portion 5. Although not shown, the top 11 and side portions 7 and 9 may be sloped towards end portion 3 to enhance the collapsible feature of the novelty device.

The base 1 includes a recess 2 therein which is adapted to receive the mouse trap 15 which may be fastened to the base 1 by any conventional means such as glue, screws or the like. The recess 2 is also designed to receive the bottom edges of the side portions 7 and 9 and the end portions 3 and 5. Although not shown, the cover 11 includes a recess similar to that as shown for the base 1, this recess designed to receive the top edges of the side portions 7 and 9 as well as the end portions 3 and 5. With the end portions 3 and 5 engaging the appropriate stops and the lower edges and upper edges of the side portions and end portions engaging the appropriate recesses in the base 1 and cover 11, the toy bank novelty device may freestand without any attachment means thereon. The lack of any attachment means between any of the structure portions permits the toy bank novelty device to fly apart or explode when the mouse trap is activated.

In use, and with reference back to FIG. 1, a coin may be inserted through slot 13 in the cover 11. The inserted coin then strikes the mouse trap 15 situated on the base 1. The mouse trap 15 strikes the stops 20*a* and 20*b* on the side portions 7 and 9, respectively. This striking action will cause the collapsible structure to fly apart and simulate an explosion of the outdoor bathroom facility.

The toy bank novelty device may be made out of any materials, with preferred materials including wood or plastic. Although a mouse trap is depicted in combination with the novelty device, any spring activated mechanism which would cause the collapsible structure to fly apart may be used.

As such, an invention has been disclosed in terms of a preferred embodiment thereof which fulfills each and every one of the objects cf the invention as set forth hereinabove and provides a new and improved toy bank novelty device of great utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A novelty device comprising:

A) a plurality of pieces including a base, sides and a roof assembled together to form a structure;

b) said roof having a slot therethrough;

c) means for collapsing said structure comprising a mousetrap fixedly located within said structure, aid mousetrap having a movable actuator accessible through said opening.

2. The invention of claim 1, wherein said structure is made to resemble an outdoor bathroom facility.

3. The invention of claim 1, wherein said actuator comprises a trip lever of said mousetrap which, when engaged, releases a spring biased pivotable bar.

4. The invention of claim 1, wherein said means for collapsing includes a protrusion extending within said structure from another of said pieces.

5. The invention of claim 1, wherein said structure is made of wood.

6. The invention of claim 1, wherein said slot is sized to allow a coin to be dropped therethrough.

* * * * *